United States Patent [19]

Tutihasi

[11] 4,187,104

[45] Feb. 5, 1980

[54] ELECTROPHOTOGRAPHIC PHOTORECEPTOR WITH COMPOSITE INTERLAYER AND METHOD OF MAKING

[75] Inventor: Simpei Tutihasi, Webster, N.Y.

[73] Assignee: Xerox Corporation, Stamford, Conn.

[21] Appl. No.: 920,869

[22] Filed: Jun. 30, 1978

[51] Int. Cl.[2] ..... G03G 5/14; G03G 5/082; B05D 5/12

[52] U.S. Cl. ..... 430/57; 427/76; 430/84; 430/128

[58] Field of Search ..... 96/1.5 R, 1.8; 427/76

[56] References Cited

U.S. PATENT DOCUMENTS

| | | | |
|---|---|---|---|
| 3,554,742 | 1/1971 | Gramza et al. | 96/1.5 R |
| 3,655,377 | 4/1972 | Sechak | 427/76 X |
| 3,713,821 | 1/1973 | Angelini | 96/1.5 R |
| 3,775,109 | 11/1973 | Ohta et al. | 96/1.5 R |
| 3,888,667 | 6/1975 | Lee | 96/1.5 R |
| 3,891,435 | 6/1975 | Lee | 96/1.5 R |
| 4,008,082 | 2/1977 | Beschoner et al. | 96/1.5 R |
| 4,094,675 | 6/1978 | Beschoner et al. | 427/76 X |

*Primary Examiner*—Roland E. Martin, Jr.

*Attorney, Agent, or Firm*—Harvey M. Brownrout; Peter H. Kondo; James P. O'Sullivan

[57] ABSTRACT

There is described an electrophotographic photoreceptor comprising a conductive metallic substrate, a composite interfacial structure made up of a layer comprising organic thermoplastic polymeric adhesive material and a thin layer of arsenic triselenide, and a photoconductive insulating layer comprising selenium or its alloys. The photoreceptor is formed by a method which includes depositing the arsenic triselenide layer while the substrate temperature is held at or above the softening point of the thermoplastic polymeric adhesive material but below the crystallization temperature of the arsenic triselenide and then depositing a layer of selenium or selenium alloy while the substrate temperature is held below the softening point of adhesive material and below the crystallization temperature of the selenium or selenium alloy. The photoreceptor exhibits a strong mechanical bond between the adhesive material and the arsenic triselenide layer and a strong bond between the arsenic triselenide and the photoconductive layer.

6 Claims, 1 Drawing Figure

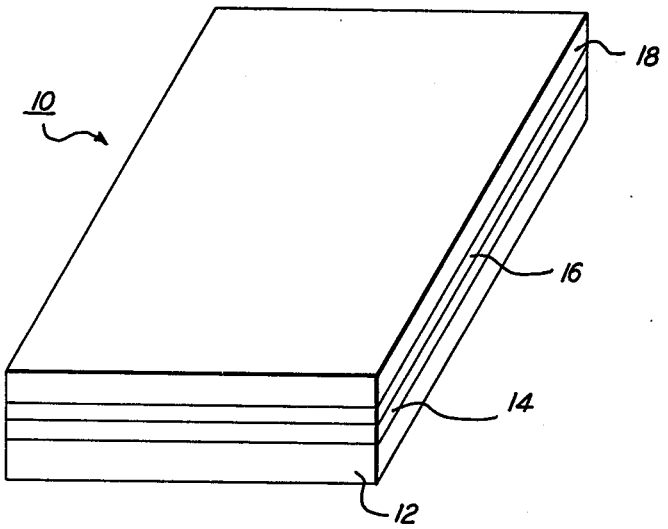
10
18
16
14
12

ELECTROPHOTOGRAPHIC PHOTORECEPTOR WITH COMPOSITE INTERLAYER AND METHOD OF MAKING

BACKGROUND OF THE INVENTION

This invention is directed to an electrophotographic photoreceptor. More particularly, the invention is directed to a photoreceptor having a composite interfacial layer.

The formation and development of images on the imaging surfaces of photoconductive materials by electrostatic means is well known. The best known of the commercial processes, more commonly known as xerography, involves forming an electrostatic latent image on the imaging surface of an imaging member by first uniformly electrostatically charging the surface of the imaging layer in the dark and then exposing this electrostatically charged surface to an imagewise pattern of activating electromagnetic radiation. The light-struck areas of the imaging layer are thus rendered relatively conductive and the electrostatic charge selectively dissipated in these irradiated areas. After the photoconductor is exposed, the electrostatic latent image on this image bearing surface is typically rendered visible with a finely divided colored marking material, known in the art as "toner". This toner will be principally attracted to those areas on the image bearing surface which retain the electrostatic charge and thus form a visible powder image. The electrostatic latent image may also be used in a host of other ways as, for example, electrostatic scanning systems may be employed to "read" the latent image or the latent image may be transferred to other materials by TESI techniques and stored. A developed image can then be read or permanently affixed to the photoconductor where the imaging layer is not to be reused.

In the commercial "plain paper" copying systems, the latent image is typically developed on the surface of a reusable photoreceptor, subsequently transferred to a sheet of paper and affixed thereto to form a permanent reproduction of the original object. The imaging surface of the photoreceptor is then cleaned of any residual toner and additional reproductions of the same or other original objects can be made thereon.

Xerographic photoreceptors typically exhibit a reduction in potential or voltage leak in the absence of activating illumination which is known as "dark decay" and also typically exhibit a variation in electrical performance upon repetitive cycling which is known as "fatigue". The problems of dark decay and fatigue are well known in the art. They have been significantly reduced by the incorporation of an interface layer in the photoreceptor between the conductive substrate and the photoconductive insulating layer. Many materials, both organic and inorganic, which are suitable for use in the interface are known in the art. See, for example, U.S. Pat. No. 2,901,348.

In addition to the electrical requirements of such interface layers, it is also necessary that they meet certain requirements with regard to mechanical properties such as adhesion of the photoconductive layer thereto and, depending upon the type of imaging member, overall flexibility in some instances. For example, when using a flexible photoreceptor such as a continuous belt, the photoconductive insulating layer and the interface layer should be properly matched so as to have the required electrical and mechanical stability. Some interface layers tend to spall or crack after repeated flexing thus resulting in sections of the photoconductive layer flaking off or spalling thereby rendering it no longer suitable for use.

Many compositions, both organic and inorganic, are known for use as interface materials in photoreceptors. Nevertheless, as the art of xerography has advanced and more stringent demands are imposed upon the photoreceptor because of increased performance standards such as, for example, speed of operation, flexibility requirements, etc., there is a continuing need for new and improved interface structures which meet both the required electrical and mechanical properties for use in particular applications. The present application relates to a photoreceptor having a novel composite interface structure.

PRIOR ART STATEMENT

U.S. Pat. No. 3,713,821 describes an electrophotographic photoreceptor having an organic interface layer comprising a polycarbonate resin and a polyurethane resin. U.S. Pat. No. 4,008,082 describes a method for preparing a photoreceptor wherein a photoconductive layer of selenium, a selenium alloy or a selenium compound is formed by initially vapor depositing a thin layer of the photoconductor while the temperature of the substrate is maintained above the glass transformation of the photoconductor and then vapor depositing the remainder of the photoconductive layer while maintaining the substrate temperature substantially lower than such glass transformation temperature.

SUMMARY OF THE INVENTION

It is the object of this invention to provide a novel process for forming an electrophotographic photoreceptor.

Another object of the invention is to provide a flexible electrophotographic photoreceptor.

It is a further object of the invention to provide a method for forming a photoreceptor having improved mechanical properties.

Yet another object of the invention is to provide a process for forming a photoreceptor having a composite interfacial structure made up of a layer comprising organic thermoplastic polymeric adhesive material and an arsenic triselenide layer, and a photoconductive insulating layer comprising selenium or its alloys.

BRIEF SUMMARY OF THE INVENTION

These and other objects and advantages are accomplished in accordance with the invention by providing an electrophotographic photoreceptor comprising a conductive metallic substrate, a composite interface structure made up of a layer comprising organic thermoplastic polymeric adhesive material and a layer of arsenic triselenide, and a photoconductive insulating layer comprising selenium or it alloys. The photoreceptor is formed by a method which includes depositing the arsenic triselenide layer while the substrate temperature is held at or above the softening point of the thermoplastic polymeric adhesive material but below the crystallization temperature of the arsenic triselenide and then depositing the photoconductive layer comprising selenium or selenium alloy while the substrate temperature is held below the softening point of the adhesive material and below the crystallization temperature of selenium or selenium alloy. The term "softening point"

as used herein is defined in the 1973 Annual Book of ASTM Standards, General Test Methods, Part 30, July 1973, Standard Method of Test for Softening Point by Ring-and-Bell apparatus, ASTM E-28-67 (Reapproved 1972).

The arsenic triselenide layer is typically very thin, having an average thickness in the range of from about 0.1 to about 1 micron, and substantially reduces injection of electrons from the adhesive material layer into the photoconductive layer. Deposition of the arsenic triselenide layer at a relatively high temperature ensures good bonding of the arsenic triselenide layer to the adhesive material layer and provides the arsenic triselenide in its amorphous form. Deposition of the photoconductive insulating layer at a relatively low temperature ensures a good surface structure and avoids crystallization of the photoconductor during deposition. The photoconductive layer bonds very tightly to the arsenic triselenide layer since both layers share a common element when the photoconductive layer is a selenium alloy other than arsenic triselenide or selenium per se. The success of this technique is not fully understood but it is believed that the combination of the softened polymeric layer with the high arsenic content selenium compound results in a tenacious bond.

BRIEF DESCRIPTION OF THE DRAWING

For a more complete understanding of the invention as well as other objects and further features thereof, reference is made to the following detailed description of various preferred embodiments thereof taken in conjunction with the accompanying drawing wherein:

The FIGURE represents a partially schematic perspective illustration of an electrophotographic photoreceptor according to the invention.

DESCRIPTION OF THE PREFERRED EMBODIMENTS

Referring now to the FIGURE there is illustrated a photoreceptor generally designated 10 according to the invention which comprises an electrically conductive substrate 12. Substrate 12 may comprise a conventional metal such as brass, aluminum, steel, nickel or the like. The substrate may be a single layer of the conductive material or it may be a conductive layer residing on a supporting layer which may itself be a different conductive material or a non-conducting organic or inorganic material. The substrate may be opaque or substantially transparent and may also be of any convenient thickness. It may be rigid or flexible and can be provided in any suitable form such as, for example, a sheet, web cylinder, endless belt or the like. A preferred substrate according to the invention comprises an endless, flexible, seamless xerographic belt which comprises nickel.

Overlying substrate 12 is a layer comprising organic thermoplastic polymeric adhesive material 14. The adhesive material layer is part of the composite interfacial structure of the member according to the invention. Layer 14 may comprise any suitable organic thermoplastic material such as, for example, polyesters, polycarbonates, polyurethanes, etc., or blends or mixtures thereof and typically has an average thickness of from about 0.5 to about 3.0 microns. In addition to the thermoplastic polymeric adhesive material, other additives may be present in layer 14. Such additives can include small amounts of conductive or photoconductive pigments such as copper phthalocyanine, zinc oxide (electrography grade), cadmium sulfoselenide and metal-free phthalocyanine. Generally such additives are used to control the resistivity of layer 14. A strong mechanical bond is formed between the adhesive material layer 14 and substrate 12.

A preferred adhesive material layer according to the invention comprises a mixture or blend of a polycarbonate resin and a polyurethane resin. In such a layer generally the ratio by weight of the polycarbonate resin to the polyurethane resin should be kept within the range of from about 1:1 to about 7:1 by weight. Additionally, it is preferred to include small amounts of an additive such as copper phthalocyanine to render the polycarbonate-polyurethane layer relatively more conductive. A detailed description of typical polycarbonate resins and typical polyurethane resins together with other additives which may be used in layer 14 and procedures for forming such a layer are given in U.S. Pat. No. 3,713,821, the entire disclosure of which is hereby incorporated by reference herein.

Overlying layer 14 is a layer of arsenic triselenide 16 which may have an average thickness of from about 0.1 to about 1.0 micron and optimally is about 0.5 micron in average thickness. The arsenic triselenide is vacuum deposited while the temperature of the conductive substrate 12 and adhesive material layer 14 is maintained at or above the softening point of the thermoplastic polymeric material comprising layer 14 but below the crystallization temperature of the arsenic triselenide. The softening point of the preferred polycarbonate-polyurethane resin blend or mixture is typically on the order of 80° C. The crystallization temperature of arsenic triselenide is on the order of 180°–200° C. The temperature employed in any instance may be any number of degrees above the softening point of the adhesive material(s) and should not exceed the crystallization temperature of the arsenic triselenide. By depositing the arsenic triselenide layer under these conditions, there is provided a strong mechanical bond between the arsenic triselenide and the underlying thermoplastic adhesive material layer 14, and the arsenic triselenide is provided in its amorphous form. The arsenic triselenide layer substantially prevents injection of electrons from the conductive substrate into the photoconductive insulating layer 18. Therefore the presence of arsenic triselenide layer 16 in the photoreceptor reduces the electron injection component of the dark decay rate of the photoreceptor and results in a desirable reduction of its dark decay rate.

Subsequently photoconductive layer 18 which comprises selenium or its alloys is vacuum deposited over arsenic triselenide layer 16 while the temperature of the underlying part of the photoreceptor is maintained below the crystallization temperature of selenium or selenium alloy (~75° C.) and below the softening point of the adhesive. Generally, a temperature of below about 65° C. is suitable. Preferably a temperature in the range of from about 30° C. to about 65° C. is used. With lower temperatures there is a tendency for trapping sites to be present in the photoconductive layer. Such trapping sites are undesirable because they typically adversely affect the xerographic electrical properties of the photoreceptor. By vacuum evaporating the photoconductive insulating material while the underlying part of the photoreceptor is held at a relatively low temperature, there is ensured a smooth surface structure for photoconductive layer 18. Moreover, crystallization of the selenium or selenium alloy can be avoided in this manner. As noted previously, it is preferred that the selenium present in layer 18 be in the amorphous form since crystalline selenium is typically more brittle and has a higher dark decay rate. A very strong bond is formed between layers 16 and 18 due to the presence of a common element, namely selenium, therein.

Photoconductive layer 18 may have any thickness which is satisfactory for use in known xerographic members. Typically layer 18 has an average thickness in the range of from about 10 to about 80 microns. Preferably, photoconductive layer 18 comprises an alloy of selenium and arsenic which has been doped with a halogen such as chlorine or iodine to improve the electrical characteristics thereof. Such alloys preferably contain from about 1 to about 25 percent by weight of arsenic and from about 100 to 5,000 parts per million of halogen. A complete description of halogen-doped alloys of selenium and arsenic is provided in U.S. Pat. No. 3,312,548, the entire disclosure of which is hereby incorporated by reference herein. Another preferred photoconductive material comprises selenium alloyed with from about 0.1 to about 14.5 atomic percent of germanium and optionally doped with from about 10 to about 10,000 parts per million of a halogen.

The photoreceptors provided according to the invention exhibit excellent adhesion of the individual layers to one another and are therefore particularly well suited for use in applications requiring a photoreceptor having a high degree of flexibility. The photoreceptors also exhibit the requisite electrical characteristics for use in xerographic imaging applications.

The advantageous photoreceptors of the invention may be used in any of the known electrophotographic imaging methods. In the best known of the commercial electrophotographic processes, commonly known as xerography, an electrostatic latent image is formed on the surface of the photoreceptor by uniformly electrostatically charging the surface of the member in the dark and then exposing this electrostatically charged surface to an imagewise pattern of activating electromagnetic radiation. Typically in the known commercial process the exposure is carried out with visible light which is directed on the photoreceptor from above the photoconductive layer. In such an embodiment, the thin arsenic triselenide layer 16 does not play any substantial role in the photogeneration of charge carriers within the member. This is because of the well known fact that selenium layers absorb substantially all of the incident radiation within the absorption band of selenium in the first 2–3 microns of the layer. Thus, photoconductive layer 18 is the primary source of the photogenerated charge carriers which are required to selectively dissipate the electrostatic charge in the irradiated areas of the photoreceptor. Of course, a very small amount of the incident radiation which is within the absorption band of selenium may reach arsenic triselenide layer 16 as will any incident radiation which is not substantially absorbed by selenium or the particular selenium alloy present in photoconductive layer 18. In this manner, arsenic triselenide layer 16 may provide some small amount of photogenerated charge carriers. It is clearly apparent therefore that the primary role of the arsenic triselenide layer 16 is as a component of the composite interface structure as described above. However, there is no intention to limit the use of such photoreceptors to imaging methods wherein exposure is made from above. As noted previously, the substrate 12 may be substantially transparent and when such a substrate is present in the member, the exposure may be effected through the substrate as well as from above the photoconductive layer. When rear exposure is carried out, it is apparent that the arsenic triselenide layer 16 will play a major part in the photogeneration of charge carries within the member, since a 0.1 micron thick arsenic triselenide layer can absorb 60% of the actinic portion of the incident light from the rear. An additional advantage is obtained in the rear exposure embodiment since arsenic triselenide exhibits good sensitivity in the red region thus broadening the overall spectral response of the photoreceptor. It should be noted that where the rear exposure mode is used, the member must be charged to a negative polarity and where the top exposure mode is used, positive polarity charging is required.

Subsequent to the exposure step, the electrostatic latent image is developed to form a visible image by any of many suitable xerographic development techniques. The visible image is typically transferred to a receiver member, e.g. paper, and affixed thereto after which the surface of the photoreceptor is cleaned to remove any residual toner material so as to prepare it for the formation of other visible images. Prior to the formation of a subsequent image, any residual electrostatic charge remaining on the photoreceptor is preferably erased such as by uniform exposure of the member to the appropriate illumination. Where the photoreceptor was charged to a negative polarity during imaging, the erasing illumination must be directed through the substrate. Any suitable charging, exposure, development, transfer, erasure and cleaning techniques may be used. These are well known in the art and therefore extensive discussion of such techniques is not required here.

The invention will now be further described in detail with respect to specific preferred embodiments by way of examples, it being understood that these are intended to be illustrative only and the invention is not limited to the materials, conditions, process parameters, etc., recited therein. All percentages recited are by weight unless otherwise specified.

EXAMPLE I

A first control member was made initially providing a sample of an approximately 4.5 mil thick flexible nickel belt carrying an approximately 1 micron thick interface layer made up of polycarbonate resin, polyurethane resin and copper phthalocyanine. The sample was placed on a brass heating block in a vacuum bell jar and then the temperature of the block was raised to about 175° C. and allowed to remain there for about 5–10 minutes. The temperature of the heating block was then lowered to about 60° C. and allowed to remain at that temperature until the sample came to equilibrium (about 45 minutes). An approximately 65 micron thick layer of a halogen-doped, selenium-arsenic alloy was then vacuum deposited over the interface layer.

A second control was formed in the same manner described with respect to the first control with the exception that the substrate temperature was not raised to 175° C. prior to the step of vacuum evaporating the photoconductive layer with the substrate at about 60° C.

The mechanical adhesion of the photoconductive layer was tested by immersing an approximately 2½"-×2½" piece of each member in liquid nitrogen until the temperature of the sample reached that of the liquid nitrogen (about 5 seconds). The samples were then removed from the liquid nitrogen and studied visually.

In both samples the photoconductive layer cracked and could be peeled off.

EXAMPLE II

A photoreceptor according to the invention was made by providing a sample of a flexible nickel belt carrying a polycarbonate-polyurethane layer as described in Example I. An approximately 0.3 micron thick layer of arsenic triselenide was vacuum evaporated over the adhesive layer while the member was in equilibrium with the heating block at about 175° C. This temperature is above the softening point of the polymer adhesive layer. The temperature of the block was then lowered to about 60° C. and the member was allowed to come to equilibrium. This temperature is below the softening point of the adhesive layer. An approximately 65 micron thick layer of the same photoconductive composition used in Example I was vacuum deposited over the arsenic triselenide layer.

The mechanical adhesion of the photoconductive layer was tested as described in Example I. The layer did not have any cracks and did not show any signs of damage. The sample was then subjected to static bending tests by flexing it around a ¼" diameter cylinder. There were no visible signs of damage to the photoconductive layer. Under microscopic examination at 1000X, microscopic cracks were observed in the surface of the photoconductive layer. The cracks did not propagate and did not change the imaging characteristics of the member.

The electrical characteristics of the member were tested with a device wherein the photoconductive layer was charged in the dark with a corotron and then exposed through a transparent electrometer probe. The surface potential was measured before and after exposure. The results obtained showed that the member was suitable for use in xerographic imaging applications.

The sample was then employed to form a reproduction of an original object using a Xerox Model D Processor. The sample was charged to a potential of about 800 volts with positive polarity and exposed to an original object and then developed with toner. A good quality xerographic image was obtained.

EXAMPLE III

The procedure of Example II was repeated with the exception that the arsenic triselenide layer had a thickness of about 0.6 micron. The photoconductive layer exhibited minor peeling when immersed in liquid nitrogen. The xerographic electrical characteristics of the member were found to be satisfactory.

EXAMPLE IV

The procedure of Example II was repeated with the exception that the arsenic triselenide layer had a thickness of about 1.0 micron. The photoconductive layer exhibited minor peeling of the same extent as observed in Example III after immersion in liquid nitrogen.

The xerographic discharge curve of the member was obtained. The member accepted a charge of +1820 volts and discharged very much the same way it did before treatment with liquid nitrogen.

EXAMPLE V

A 5"×7" sheet of approximately 5 mil thick aluminumized Kapton (a polyamide available from E. I. duPont de Nemours) was coated with an approximately 0.6 micron thick interface layer of the type described in Example I. The coated substrate was attached to the brass heating block in a vacuum bell jar, the temperature of the block raised to about 175° C. and the sample allowed to come to equilibrium. An approximately 0.2 micron thick arsenic triselenide layer was vacuum evaporated over the interface layer. The temperature of the block was then lowered to about 60° C., the sample allowed to come to equilibrium and an approximately 50 micron thick layer of the photoconductive composition described in Example I was deposited over the arsenic triselenide layer.

The mechanical strength of the member was tested with an Instron Tensile Tester. The stress at the failure point was 1500 psi and the observed failure was in the bulk of the photoconductive insulating layer in the form of cracking before the adhesion between the latter layer and the polycarbonate-polyurethane layer occurred. The strain at the failure point was about 0.4%.

EXAMPLE VI

The procedure of Example V was repeated with the exception that an arsenic triselenide layer of about 0.3 micron thickness was formed. The stress at the failure point was 2500 psi. The strain at the failure point was about 0.6%.

EXAMPLE VII

The procedure of Example V was repeated with the exception that the arsenic triselenide layer was about 0.4 micron thick. The stress at the failure point was 5800 psi. The strain at the failure point was about 1.7%.

EXAMPLE VIII

The procedure of Example V was repeated and the member so formed was used to make a xerographic reproduction using a Xerox Model D Processor. A good quality xerographic print was obtained.

Although the invention has been described with respect to specific preferred embodiments, it is not intended to be limited thereto but rather those skilled in the art will recognize that variations and modifications may be made therein which are with the spirit of the invention and the scope of the claims.

What is claimed is:

1. A method for producing an electrophotographic photoreceptor comprising:

(a) providing a substrate comprising an electrically conductive layer having arrayed on one surface thereof a layer of organic thermoplastic adhesive material having an average thickness of from about 0.5 to about 3.0 microns, (b) vacuum evaporating a layer of amorphous arsenic triselenide having an average thickness of from about 0.1 to about 1.0 micron over said adhesive layer while maintaining the temperature of said adhesive material above its softening point but below the crystallization temperature of said arsenic triselenide; and (c) vacuum evaporating a photoconductive layer of selenium or selenium alloy over said arsenic triselenide while maintaining the temperature of said substrate, adhesive material and arsenic triselenide layer below the softening point of said adhesive layer and below the crystallization temperature of selenium or selenium alloys.

2. The method of claim 1 wherein said substrate is in the form of an endless flexible belt.

3. The method of claim 2 wherein said conductive layer comprises nickel.

4. The method of claim 3 wherein said adhesive material comprises a mixture or blend of polycarbonate and polyurethane in a ratio of about 7 to about 1 part by weight polycarbonate to about 1 part by weight polyurethane, wherein step (b) is carried out at a temperature of about 175° C. and step (c) is carried out a temperature of about 60° C.

5. The method of claim 1 wherein said arsenic triselenide has an average thickness of about 0.5 micron.

6. The photoreceptor prepared by the method of claim 1.

* * * * *